US009701106B2

(12) United States Patent
Schulmeister

(10) Patent No.: US 9,701,106 B2
(45) Date of Patent: Jul. 11, 2017

(54) DIGITAL PRINTING DEVICE FOR THE DYNAMIC PRINTING OF A STATICALLY PRINTED SUBSTRATE WEB AND REEL-FED PRINTING PRESS

(71) Applicant: manroland web systems GmbH, Augsburg (DE)

(72) Inventor: Peter Schulmeister, Plaffenhofen (DE)

(73) Assignee: manroland web systems GmbH, Augsburg (DE)

( * ) Notice: Subject to any disclaimer, the term of this patent is extended or adjusted under 35 U.S.C. 154(b) by 0 days.

(21) Appl. No.: 13/971,667

(22) Filed: Aug. 20, 2013

(65) Prior Publication Data

US 2014/0053749 A1 Feb. 27, 2014

(30) Foreign Application Priority Data

Aug. 21, 2012 (DE) ..... 10 2012 107 664

(51) Int. Cl.

| | |
|---|---|
| ***B41F 1/34*** | (2006.01) |
| ***B41F 27/00*** | (2006.01) |
| ***B41F 33/00*** | (2006.01) |
| ***B41F 13/46*** | (2006.01) |
| ***B41F 19/00*** | (2006.01) |

(52) U.S. Cl.

CPC ..... *B41F 27/005* (2013.01); *B41F 13/46* (2013.01); *B41F 19/007* (2013.01); *B41F 33/00* (2013.01)

(58) Field of Classification Search

CPC .... B41F 33/0045; B41F 27/005; B41F 13/46; B41F 19/007; B41J 2/02

See application file for complete search history.

(56) References Cited

U.S. PATENT DOCUMENTS

| | | | |
|---|---|---|---|
| 3,913,719 | A | 10/1975 | Frey |
| 5,906,156 | A | 5/1999 | Shibuya et al. |

(Continued)

FOREIGN PATENT DOCUMENTS

| | | | |
|---|---|---|---|
| CN | 102431277 | A | 5/2012 |
| CN | 102648138 | A | 8/2012 |
| DE | 197 17 297 | A1 | 11/1998 |

(Continued)

OTHER PUBLICATIONS

European Search Report dated Feb. 17, 2014, with Statement of Relevancy (Five (5) pages).

(Continued)

*Primary Examiner* — Matthew G Marini
(74) *Attorney, Agent, or Firm* — Crowell & Moring LLP

(57) ABSTRACT

A digital printing device for the dynamic printing of a substrate web statically printed in a reel-fed printing press is disclosed. The digital printing device includes a position sensor which measures the substrate web for regulating a print position for the dynamic printing. The digital printing device is provided with a signal from a signal source of the reel-fed printing press. A position sensor control generates a synchronization signal and provides the synchronization signal to a digital printing head control. A speed signal transformer generates a feed signal and provides the feed signal to the digital printing head control. The digital printing head control activates the digital printing head dependent on the synchronization signal and the feed signal.

12 Claims, 2 Drawing Sheets

(56) References Cited

U.S. PATENT DOCUMENTS

| | | | | |
|---|---|---|---|---|
| 2009/0095185 | A1 | 4/2009 | Naegele et al. | |
| 2012/0219340 | A1* | 8/2012 | Rumsby | 400/76 |

FOREIGN PATENT DOCUMENTS

| | | | |
|---|---|---|---|
| DE | 10 2007 028 452 | | 12/2008 |
| DE | 10 2007 028 454 | | 12/2008 |
| DE | 10 2007 032 004 | A1 | 1/2009 |
| JP | 11-291461 | A | 10/1999 |
| JP | 2001-171088 | A | 6/2001 |

OTHER PUBLICATIONS

Chinese Office Action issued in Chinese counterpart application No. 201310366192.3 dated Jul. 21, 2016, with English translation (Fifteen (15) pages).

German Office Action issued in German counterpart application No. 10 2012 107 664.2 dated Mar. 21, 2013 (Four (4) pages).

* cited by examiner

DIGITAL PRINTING DEVICE FOR THE DYNAMIC PRINTING OF A STATICALLY PRINTED SUBSTRATE WEB AND REEL-FED PRINTING PRESS

This application claims the priority of German Patent Application No. 10 2012 107 664.2, filed Aug. 21, 2012, the disclosure of which is expressly incorporated by reference herein.

BACKGROUND AND SUMMARY OF THE INVENTION

The invention relates to a digital printing device for the dynamic printing of a statically printed substrate web and a reel-fed printing press with such a digital printing device.

Reel-fed printing presses have a plurality of printing units for the static printing of at least one substrate web surface of at least one substrate web with a print image that is the same or print copies, and thus, static. Each print copy in this case typically comprises a plurality of printing pages. Such printing units, which serve for the static printing of the or each substrate web are typically embodied as offset printing units. It is likewise possible that such printing units are embodied as gravure printing units.

In reel-fed printing presses known from the prior art it is already usual to provide at least one digital printing device in addition to the printing units, which serve for the static printing of the or each substrate web with a print image that is the same for all print copies, in order to individualize the print copies through dynamic printing. Such a digital printing device for the dynamic printing preferentially is an inkjet printing device, with the help of which at least one substrate web surface of at least one substrate web can be printed with a print image that is variable for at least some print copies, i.e. printed dynamically.

A reel-fed printing press with a digital printing device for the dynamic printing of a statically printed substrate web in the line for the static printing in the reel-fed printing press is known, for example, from German Patent Document No. DE 10 2007 028 454 A1 and from German Patent Document No. DE 10 2007 028 452 A1.

It is known furthermore from the prior art that a digital printing device for the dynamic printing of an already statically printed substrate web comprises at least one digital printing head preferentially embodied as an inkjet printing head, wherein the digital printing head together with a position sensor is relocateably mounted on a cross member transversely to the transport direction of the substrate web. With the help of the position sensor, the substrate web to be dynamically printed can be measured in order to determine the print position for the dynamic printing of the substrate web with regard to a control.

Although the individualization of statically printed substrate webs with dynamic impressions is already known in principle, the integration of a digital printing device for the dynamic printing in a reel-fed printing press poses difficulties, in particular it is not ensured to date that the dynamic printing of a statically printed substrate web can be carried out in line with the static printing in the reel-fed printing press in a user-friendly manner with little effort.

Starting out from this, the object of the present invention is to create a new type of digital printing device for the dynamic printing of a statically printed substrate web and a reel-fed printing press with such a digital printing device.

According to the invention, the digital printing device can be provided with a signal via an interface from a signal source of the reel-fed printing press, which at least comprises a speed signal of the reel-fed printing press and a cylinder trigger signal of the reel-fed printing press, wherein a position sensor control dependent on the cylinder trigger signal and on measurement values of the or each position sensor generates a synchronization signal for the digital printing device out of the cylinder trigger signal, making it available to a digital printing head control, wherein a speed signal transformer dependent on the speed signal and a predetermined dynamic print resolution generates a feed signal for the digital printing device out of the speed signal, making it available to the digital printing head control, and wherein the digital printing head control activates the or each digital printing head as a function of the synchronization signal and as a function of the feed signal.

With the invention it is provided to exclusively connect the digital printing device via a signal source of the reel-fed printing press with respect to data which are time-critical to the dynamic printing. Thus, the signal source of the reel-fed printing press provides the digital printing device with a signal, which on the one hand comprises a speed signal of the reel-fed printing press and on the other hand a cylinder trigger signal of the reel-fed printing press.

Dependent on the cylinder trigger signal and on measurement values of the or each position sensor, the position sensor control determines the synchronization signal for the digital printing device out of the cylinder trigger signal, making this synchronization signal available to the digital printing head control.

Dependent on the speed signal of the reel-fed printing press and the predetermined dynamic print resolution, the speed signal transformer determines the feed signal for the digital printing device for the dynamic printing out of the speed signal of the reel-fed printing press, making it available to the digital printing head control.

Based on the synchronization signal and the feed signal, the digital printing head control activates the or each digital printing head in order to dynamically print the respective substrate web in addition to the static printing of the substrate web in the reel-fed printing press in line and because of this to be able to also carry out individualizations of print copies.

Furthermore, the maximum print speeds of the dynamic printing and of the static printing can be limited and matched to one another through a data comparison with a predetermined print resolution for the dynamic printing. The data comparison is carried out at least between the speed signal of the reel-fed printing press and the feed signal for the digital printing device.

The system architecture of the digital printing device according to the invention for the dynamic printing of a statically printed substrate web in line in the reel-fed printing press allows in a user-friendly way the individualization of statically printed substrates with a dynamic impression.

Preferentially, the signal source of the reel-fed printing press, the or each position sensor, the position sensor control, the speed signal transformer, the digital printing head control and the or each digital printing head for the dynamic printing exchange time-critical data preferentially as hardware signals.

The or each position sensor, the position sensor control, the speed signal transformer, the digital printing head control and an operator interface additionally exchange non-time-critical data preferentially as network signals for the dynamic printing by way of a data network.

The data exchange of the time-critical data for the dynamic printing by way of hardware signals and the data exchange of the non-time-critical data for the dynamic printing as network signals is particularly preferred and allows a simple integration of the digital printing device for the dynamic printing in the reel-fed printing press.

No intervention in existing control systems of the reel-fed printing press is required in order to integrate a digital printing device for the dynamic printing in a reel-fed printing press.

According to an advantageous further development of the invention, the digital printing device for the dynamic printing can be provided with the signal, which comprises the speed signal and the cylinder trigger signal from the single signal source of the reel-fed printing press, wherein the single signal source of the reel-fed printing press is either a central pickup of the reel-fed printing press or an encoder of the reel-fed printing press. A central pickup is present in all reel-fed printing presses known from practice and can provide the signal, which comprises the speed signal and the cylinder trigger signal, to the digital printing device for the dynamic printing without further hardware effort. Alternatively, the signal can be provided by an encoder, which is assigned to a printing press cylinder.

Preferred further developments of the invention are obtained from the following description. An exemplary embodiment of the invention is explained in more detail by the drawings without being restricted thereto

DETAILED DESCRIPTION OF THE DRAWINGS

Figure 1:
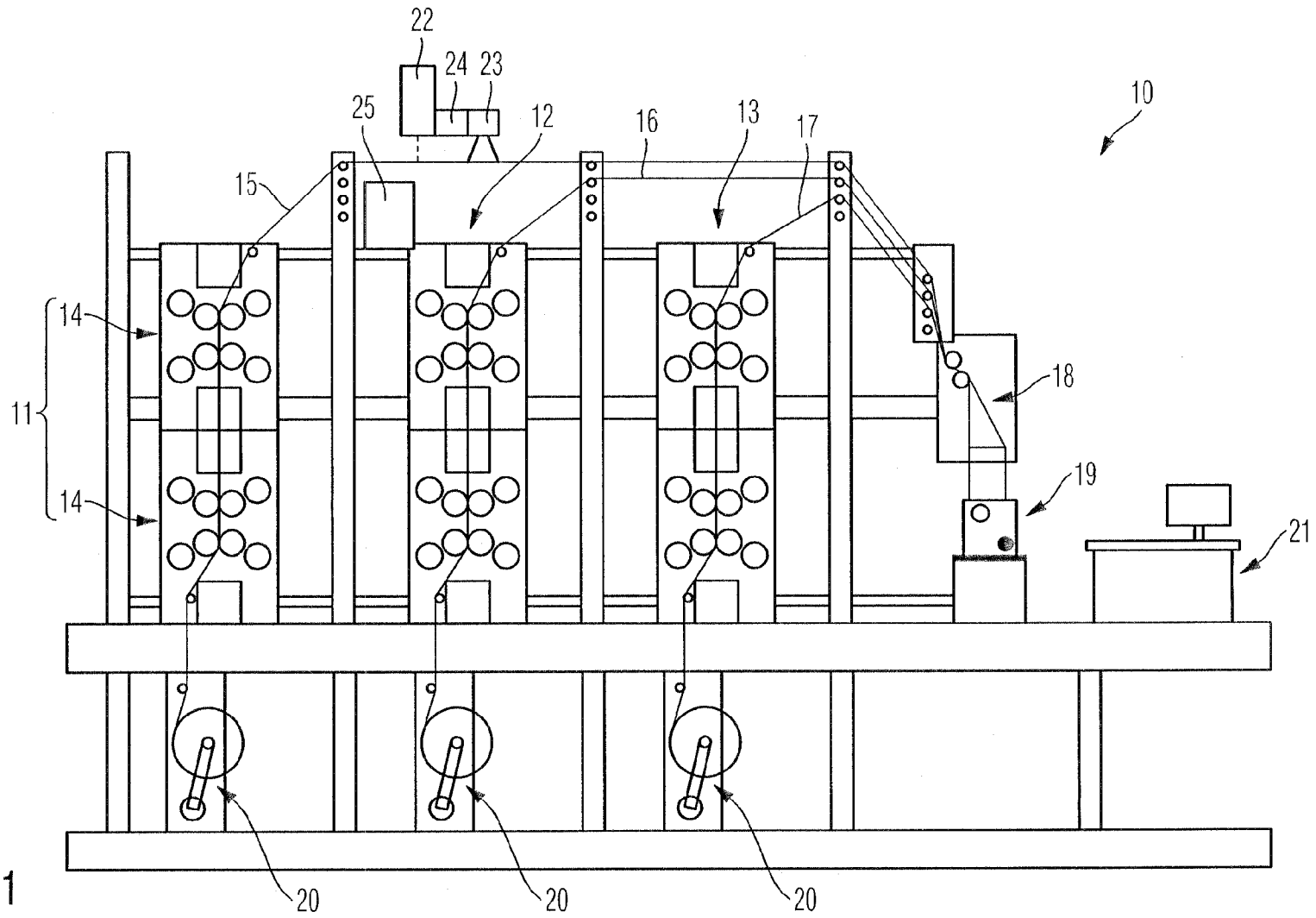
FIG. 1 is a schematic representation of a reel-fed printing press with a digital printing device for the dynamic printing of a substrate web statically printed in the reel-fed printing press.

FIG. 1 shows a schematic representation of a reel-fed printing press 10 with a plurality of printing towers 11, 12 and 13, wherein each of the printing towers 11, 12 and 13 in the shown exemplary embodiment comprises two printing units 14 positioned on top of one another. Each printing tower 11, 12 and 13 serves for the static printing of a substrate web 15, 16 and 17 with a print image that is the same for all print copies, and thus, static. The substrate webs 15, 16 and 17 statically printed in the printing towers 11, 12 and 13 can be fed to a folding apparatus 19 via a former 18. Alternatively, other further processing devices such as a rewinder or sheeter can be provided.

The substrate webs 15, 16 and 17 to be printed are unreeled from corresponding substrate reels in the region of reel changers 20. By way of a printing press control station 21, the static printing process of the reel-fed printing press 10 can be controlled or regulated.

According to FIG. 1, a digital printing device for the dynamic printing of the statically printed substrate web 15 is integrated in the reel-fed printing press 10, wherein this digital printing device for the dynamic printing comprises at least one digital printing head 22, which together with at least one position sensor 23, is relocateably mounted on at least one cross member 24 transversely to the transport direction of the substrate web 15. In the following, for the sake of simplicity, it is to be assumed that a single position sensor 23 together with at least one digital printing head 22 is relocateably mounted on a single cross member 24.

The position sensor 23 can, for example, be a camera, which, for example, captures the static print image or print marks, in order to determine the print position for the dynamic printing of the substrate web by way of the or each digital printing head 22 from this. A digital printing head control 25 serves for the control or regulation of the dynamic printing of the statically printed substrate web 15.

Figure 2:
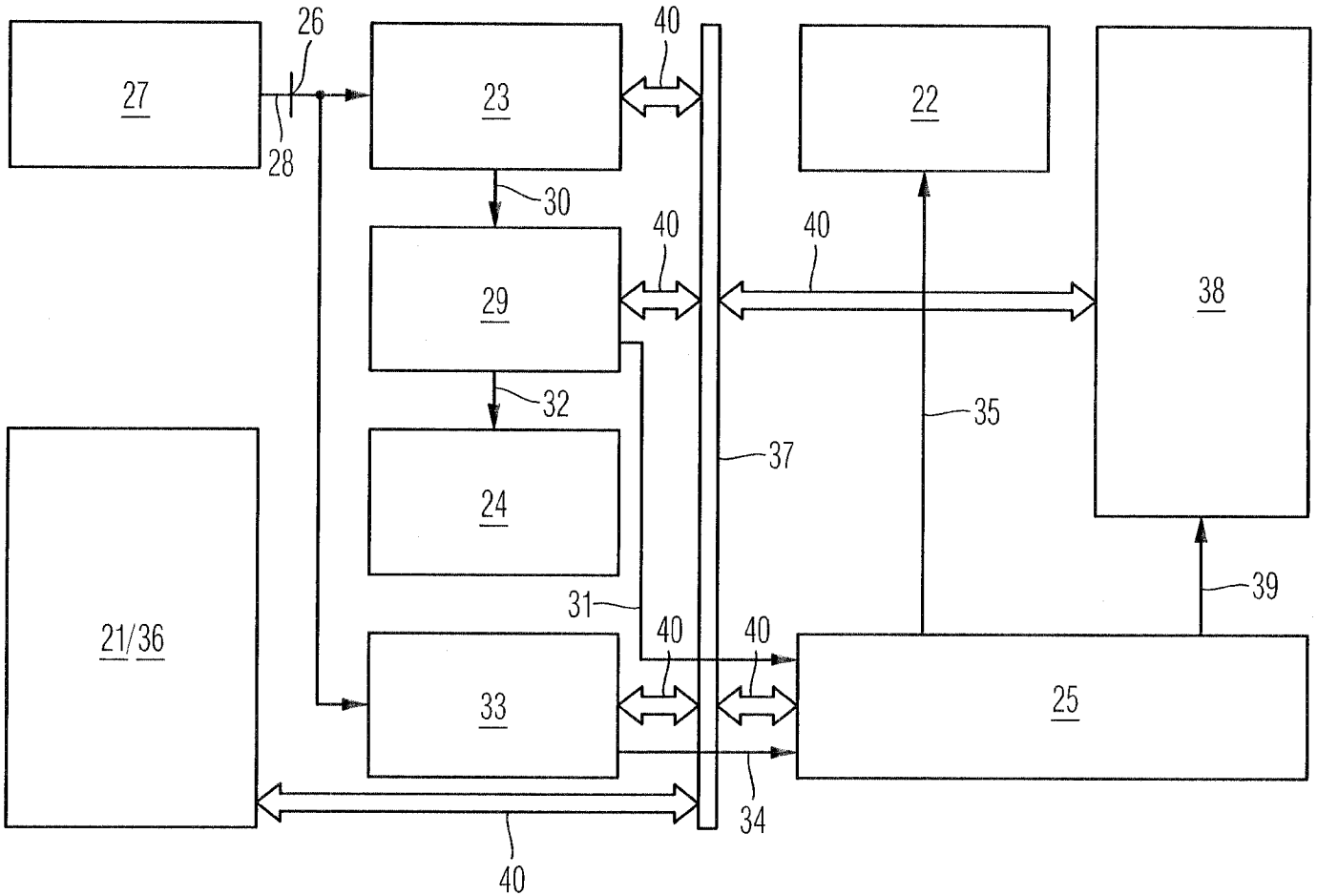
FIG. 2 is a block diagram of the digital printing device for the dynamic printing.

FIG. 2 shows details of the integration of the digital printing device for the dynamic printing in the reel-fed printing press on the control side, wherein the digital printing device for the dynamic printing of the statically printed substrate web can be provided with a signal 28 from a signal source 27 of the reel-fed printing press 10 via an interface 26, which signal 28 on the one hand comprises a speed signal of the reel-fed printing press and on the other hand a cylinder trigger signal of the reel-fed printing press.

Dependent on the cylinder trigger signal, the position sensor 23 measures the statically printed and still to be dynamically printed or already dynamically printed substrate web 15 and makes available corresponding measurement values 30 to a position sensor control 29 of the digital printing device, wherein the position sensor control 29 dependent on the cylinder trigger signal and dependent on the measurement values of the position sensor 23 determines or generates a synchronization signal 31 for the digital printing device out of the cylinder trigger signal of the reel-fed printing press, making this synchronization signal 31 available to the digital printing head control 25.

The position sensor control 29 furthermore regulates, dependent on the cylinder trigger signal and on the measurement values 30 of the position sensor 23, the impression position for the dynamic printing of the substrate web 15 and to this end activates the cross member 24 via a corresponding control signal 32.

The digital printing device for the dynamic printing according to the invention furthermore comprises a speed signal transformer 33, which depending on the speed signal of the reel-fed printing press and depending on a predetermined dynamic print resolution of the digital print and preferentially, dependent on the cylinder circumference of the reel-fed printing press, generates a feed signal 34 for the digital printing device out of the speed signal of the reel-fed printing press, making this feed signal 34 available to the digital printing head control 25.

The digital printing head control 25 of the digital printing device generates, depending on the feed signal 34 and the synchronization signal 31, an activation signal 35 for the or each digital printing head 22 and, accordingly, activates the or each digital printing head 22 dependent on the synchronization signal 31 and dependent on the feed signal 34.

All data or signals 28, 30, 31, 32, 34 and 35 described above are time-critical for the dynamic printing and are exchanged between the hardware assemblies 27, 23, 29, 24, 33, 25, and 22 involved on the control side preferentially as hardware signals. The signal source 27 of the reel-fed printing press accordingly makes available the signal 28 preferentially as a hardware signal. The signals 30, 32, 31, 34 and 35 are preferentially exchanged as hardware signals between the assemblies 23, 29, 24, 33, 25 and 22 involved.

Furthermore, the position sensor 23, the position sensor control 29, the speed signal transformer 33, the digital printing head control 25 and an operator interface 36 of the digital printing device, which is preferentially an integral part of the printing press control station 21, are connected to a network 37, via which the same data can be exchanged preferentially as network signals, namely such data which are non-time-critical for the dynamic printing.

Thus it is possible in particular to transmit preset values for the dynamic printing to the assemblies involved, preferentially as network signals via the operator interface 36, for example a desired dynamic print resolution required in the speed signal transformer 33 and/or brightness and contrast data required for the position sensor 23 and/or set values for the print position of the dynamic printing required in the position sensor control 29.

These preset values can be input via the operator interface 36 and made available to the assemblies involved preferentially as non-time-critical network data via the network 37.

As is evident from FIG. 2, components of the reel-fed printing press and of the digital printing device for the dynamic printing of the substrate web statically printed in the reel-fed printing press on the one hand exchange time-critical data as hardware signals and on the other hand non-time-critical data as network signals. Such a data communication is particularly advantageous since because of this a simple integration of the digital printing device in the reel-fed printing press is ensured on the one hand and an easy operability can be ensured on the other hand.

FIG. 2 furthermore shows an assembly of a printing ink supply 38 of the or each digital printing head 22, wherein the printing ink supply 38 on the one hand exchanges time-critical data 39 preferentially as hardware signals with the digital printing head control 25 for the dynamic printing and non-time-critical data preferentially as network signals via the network 37 with other assemblies. The data exchange of the position sensor 23, the position control 29, the speed signal transformer 33, the operator interface 36, the digital printing head control 25 and the printing ink supply 38 via the network 37 takes place via schematically represented network interfaces 40 of the assemblies involved.

The signal source 27 of the reel-fed printing press, which makes available the signal 28 comprising the speed signal and the cylinder trigger signal via the interface 26 in the form of a hardware signal, is a central pickup of the reel-fed printing press or an encoder of the reel-fed printing press assigned to a printing press cylinder. The digital printing device merely requires a single such system, which is provided by a single signal source 27 of the reel-fed printing press. No intervention in existing regulating systems of the reel-fed printing press is required.

The position sensor control 29, which defines the synchronization signal 31, determines the synchronization signal 31 dependent on the cylinder trigger signal of the reel-fed printing press and accordingly also dependent on the number of the cylinder trigger impulses for each cylinder revolution of the reel-fed printing press 10.

The digital printing device for the dynamic printing of a statically printed substrate web in line in the reel-fed printing press allows the individualization in a user-friendly manner of statically printed substrate webs with a dynamic impression. The digital printing device makes this possible by reducing the position tolerance of the dynamic print image in particular with respect to process parameters influencing the web tension, shorter setting-up times and thus lower spoilage values. The print resolution and the print position for the dynamic impression are flexibly adaptable to circumstances of the reel-fed printing press in a user-friendly manner. Since the operator interface 36 is preferentially integrated in the control station 21, parameters of the static printing and dynamic printing can be centrally monitored on the control station and varied. A mobile operation via a mobile operator interface is also possible.

The foregoing disclosure has been set forth merely to illustrate the invention and is not intended to be limiting. Since modifications of the disclosed embodiments incorporating the spirit and substance of the invention may occur to persons skilled in the art, the invention should be construed to include everything within the scope of the appended claims and equivalents thereof.

LIST OF REFERENCE NUMERALS

10 Reel-fed printing press
11 Printing tower
12 Printing tower
13 Printing tower
14 Printing unit
15 Substrate web
16 Substrate web
17 Substrate web
18 Former
19 Folding apparatus
20 Reel changer
21 Printing press control station
22 Digital printing head
23 Position sensor
24 Cross member
25 Digital printing head control
26 Interface
27 Signal source
28 Signal
29 Position sensor control
30 Measurement values
31 Synchronization signal
32 Control signal
33 Speed signal transformer
34 Feed signal
35 Activation signal
36 Operator interface
37 Network
38 Printing ink supply
39 Data
40 Network interface

What is claimed is:

1. A digital printing device for dynamic printing of a substrate web statically printed in a reel-fed printing press, wherein the digital printing device performs the dynamic printing in line with the reel-fed printing press, comprising:

a position sensor, which together with a digital printing head, is relocateable on a cross member transversely to a transport direction of the substrate web and measures the substrate web for regulating a print position for the dynamic printing;

an interface, wherein a signal from a signal source of the reel-fed printing press is receivable by the digital printing device via the interface, wherein the signal comprises a speed signal of the reel-fed printing press and a cylinder trigger signal of the reel-fed printing press;

a position sensor control that generates a synchronization signal based on the cylinder trigger signal and a measurement value of the position sensor, and provides the synchronization signal to a digital printing head control; and a speed signal transformer that generates a feed signal based on the speed signal and a predetermined dynamic print resolution input by a user via an operator interface, and provides the feed signal to the digital printing head control;

wherein the digital printing head control activates the digital printing head in accordance with the synchronization signal and the feed signal;

and wherein a maximum printing speed of the dynamic printing and of the static printing are matched and limited to one another by a data comparison between the speed signal of the reel-fed printing press and the feed signal for the digital printing device with the predetermined dynamic print resolution.

2. The digital printing device according to claim 1, wherein the position sensor, the position sensor control, the speed signal transformer, the digital printing head control, and the digital printing head exchange time-critical data for the dynamic printing as hardware signals.

3. The digital printing device according to claim 1, wherein the position sensor control activates the cross member.

4. The digital printing device according to claim 1, wherein the signal is a hardware signal and is receivable from a central pickup of the reel-fed printing press or an encoder of the reel-fed printing press.

5. The digital printing device according to claim 1, wherein the position sensor, the position sensor control, the speed signal transformer, the digital printing head control, and the operator interface exchange non-time-critical data for the dynamic printing as network signals via a network.

6. The digital printing device according to claim 5, wherein via the operator interface preset values for the dynamic printing related to dynamic print resolution and/or brightness and contrast data for the position sensor and/or set values for the print position of the dynamic printing are adjustable and transmittable via the network as network data.

7. The digital printing device according to claim 1, wherein a printing ink supply of the digital printing head exchanges time-critical data as hardware signals with the digital printing head control and exchanges non-time-critical data as network data via a network.

8. The digital printing device according to claim 1, wherein the feed signal is dependent on a cylinder circumference of the reel-fed printing press.

9. The digital printing device according to claim 1, wherein the synchronization signal is a function of a number of cylinder trigger impulses for each cylinder revolution of a cylinder of the reel-fed printing press.

10. A printing apparatus, comprising:

a reel-fed printing press with a printing unit for static printing of a substrate web surface of a substrate web with a print image that is invariable for a print edition; and a digital al printing device of claim 1 for dynamic printing of the substrate web.

11. The printing apparatus according to claim 10, wherein the printing unit is an offset printing unit.

12. The printing apparatus according to claim 10, wherein the digital printing device includes an inkjet printing device.

* * * * *